United States Patent [19]

Dorsch

[11] Patent Number: 4,462,767

[45] Date of Patent: Jul. 31, 1984

[54] AIR PUMP

[75] Inventor: Dieter Dorsch, Heilbronn, Fed. Rep. of Germany

[73] Assignee: Günter Grittman, Uhlbach, Fed. Rep. of Germany

[21] Appl. No.: 400,236

[22] Filed: Jul. 21, 1982

[30] Foreign Application Priority Data

Jul. 23, 1981 [DE] Fed. Rep. of Germany ... 8121571[U]

[51] Int. Cl.[3] ..... F04B 19/02; F04B 21/04

[52] U.S. Cl. ..... 417/460; 417/550; 417/566; 417/DIG. 1; 222/401

[58] Field of Search ..... 417/234, 460, 550, 565, 417/566, 546; 222/401, 402; 92/175, 117 R, 117 A

[56] References Cited

U.S. PATENT DOCUMENTS

| | | | |
|---|---|---|---|
| 984,619 | 2/1911 | Truesdale et al. | 222/401 |
| 1,038,636 | 9/1912 | Oxnard | 92/117 R |
| 1,721,127 | 7/1929 | Lilly | 417/460 |
| 1,929,564 | 10/1933 | Rolph | 417/460 |
| 1,956,724 | 5/1934 | Lueck | 222/401 |
| 2,069,383 | 2/1937 | Nedbalek | 222/401 |
| 3,485,180 | 12/1969 | Wickenberg et al. | 417/550 |
| 3,785,532 | 1/1974 | Cooprider | 417/566 |
| 4,278,114 | 7/1981 | Ruberg | 417/566 |

FOREIGN PATENT DOCUMENTS

| | | | |
|---|---|---|---|
| 577266 | 5/1958 | Italy | 417/460 |

*Primary Examiner*—William L. Freeh
*Assistant Examiner*—Paul F. Neils
*Attorney, Agent, or Firm*—Kurt Kelman

[57] ABSTRACT

An air pump comprising a piston located inside a piston housing having a crown and an open end. The piston is provided with a pressure generating member in the form of a resilient membrane-like annular disc which is held centrally on one end of the piston, which is fitted in the piston housing with the annular disc and the piston plate pointed towards the crown of the piston housing whereby the rim of the membrane-like annular disc bears against the inner wall of the piston housing and the piston housing is guided on the piston in a manner enabling it to be moved axially.

5 Claims, 4 Drawing Figures

AIR PUMP

The invention relates to an air pump comprising a piston assembly located inside a piston housing and including a piston molded integrally on a piston rod a pressure-generating element, consisting of a resilient membrane-like annular disc, the disc being centered on the piston and held loosely on the outer surface of the piston, the diameter of this disc being equal to the diameter of the piston or being somewhat greater than this diameter, and the periphery of the disc bearing against the inner wall of the piston housing with a sealing fit. The piston housing has a top closure and is open on the opposite side, the piston assembly being fitted in the piston housing with the annular disc and the piston adjacent the top closure of the piston housing. The piston rod is provided with securing means at the end facing away from the piston for fixing the air pump to equipment to be supplied with air and the piston housing is axially movably guided on the piston.

Air pumps of this type are, for example, used, in conjunction with a tapping device, for dispensing liquids, especially for dispensing beverages from closed containers in which they are stored under pressure. This tapping device is fixed to the container and possesses, on the side facing away from the container, an extension piece, on which the air pump is fixed. A known air pump comprises a piston housing which is provided with a central opening for the air outlet and the piston is adjacent the opening in the housing. A pressure-generating element, made from a membrane-like annular disc, is held centrally, by means of a separate molded piece, on the outer surface of the piston. In the center, the piston possesses a stepped recess defining a shoulder accessible from the outside and forming a seat for the molded piece. This piece is provided with an edge region which is guided, with some play, along the wall of the piston housing and which runs, from the outside inwards and towards the piston, in the manner of a shallow cone, an annular plate adjoining this edge region, with a hub-extension projecting towards the piston, from the inner edge of this annular plate. This hub extension is tightly fitted into the recess in the piston, and its edge facing the piston butts against the shoulder. The membrane is held between the outer surface of the piston and the annular plate of the molded piece. The central opening in the piston housing is bounded by an annular extension, which is pointed inwards, this annular extension being seated, in a leak proof manner, on the extension piece on the tapping device, for example by being screwed on.

An air pump of this type has proved very effective for small tapping devices but the comparatively large number of individual parts renders it expensive.

The object of the invention is to provide an air pump of this type but assembled from the smallest possible number of individual parts and, as a result, being of particularly simple construction.

This object is achieved in such an air pump, the piston assembly being fitted in the piston housing with the annular disc and the piston adjacent the top closure of the piston housing, and the piston rod being provided with securing means at the end facing away from the piston, for fixing the air pump to equipment to be supplied with air, the piston housing being axially movably guided on the piston.

The air pump according to the invention, comprises a total of three components, namely the piston housing, the piston, and the pressure-generating element consisting of a membrane-like annular disc. Both the piston housing and the piston are extremely simple injection-molded components which can be assembled and disassembled without any difficulty.

The invention is explained in more detail by reference to an illustrative embodiment which is represented in the drawings, in which:

FIG. 1 shows the piston assembly P, which is located in the piston housing G, together with the pressure-generating element D close to the inside surface 2 of the top closure 1 of the piston housing G.

Figure 1:
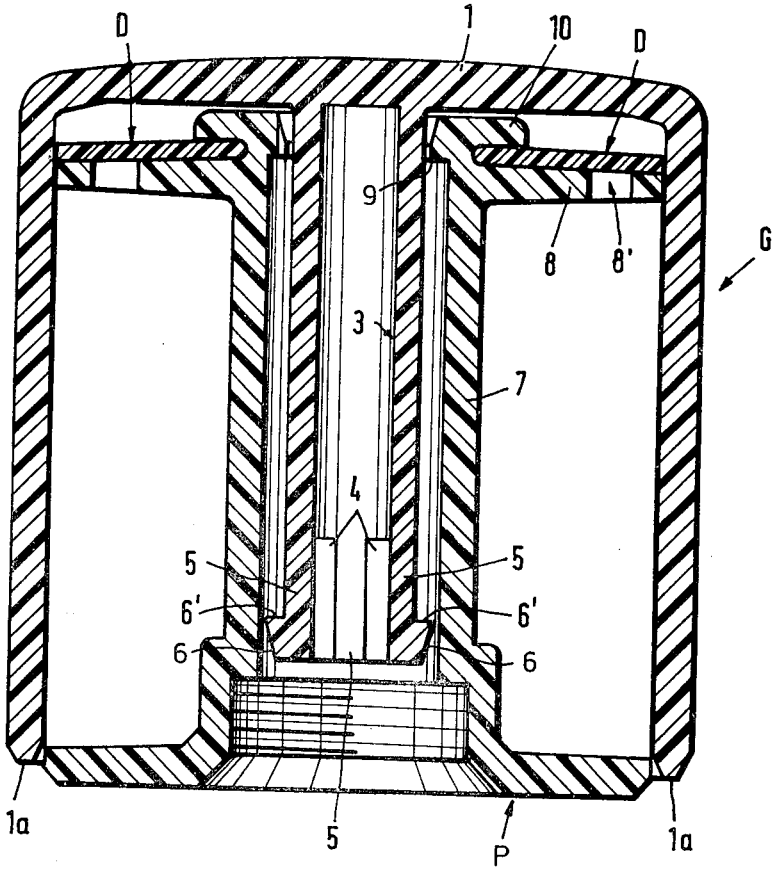
FIG. 1 shows a view, in longitudinal section, through an assembled air pump.
Figure 2:
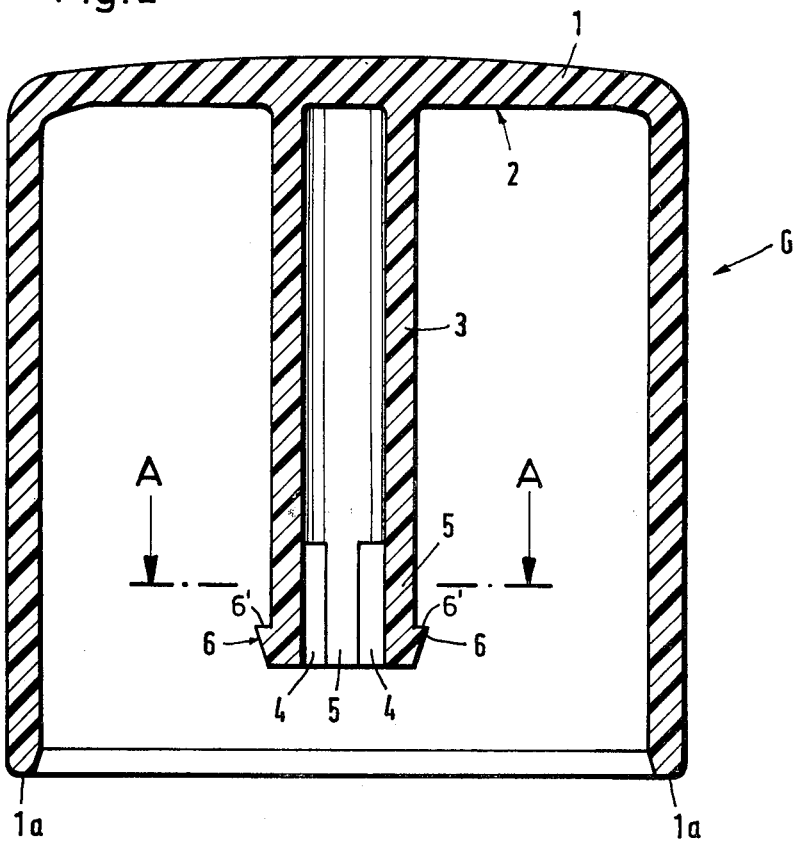
FIG. 2 shows a view, in longitudinal section, of the piston housing of the air pump.
Figure 3:
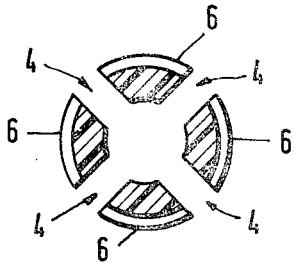
FIG. 3 shows a plan view of the free end of a cylindrical extension in the piston housing, taken along section line A—A in FIG. 2.

The piston housing G (FIGS. 1 and 2) is comprised of a cylindrical body closed on one side, by a top closure 1 and open on the side opposite thereto. A cylindrical post 3 is integrally molded at the center of the inside surface 2 to project from top closure 1 into the interior of the housing, ending somewhat above the plane which is bounded by the peripheral edge 1*a* of the piston housing G. The free end of the cylindrical post 3 is provided with at least two, preferably four, incisions 4 which preferably divide approximately $\frac{1}{4}$ to $\frac{1}{3}$ of the length of the post 3 into webs 5 which can easily bend, in a resilient manner, and which can be compressed to some extent. The end of each web 5 has an outwardly projecting detent 6, which preferably extends upwards and obliquely outwards from the end of the post 3, and terminates in shoulder 6'. The external diameter of detents 6 corresponds approximately to the internal diameter of the cylindrical piston rod 7.

Figure 4:
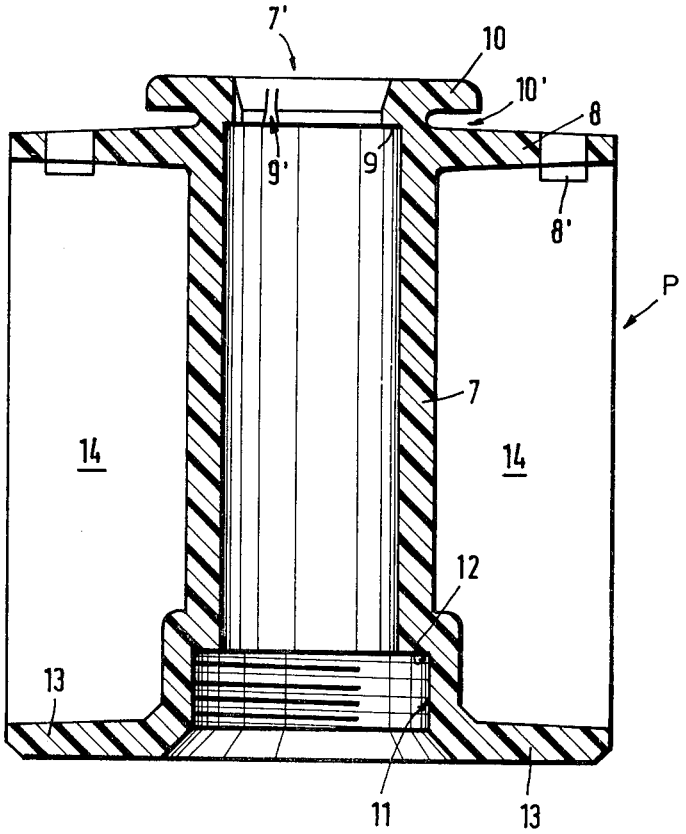
FIG. 4 shows a view, in longitudinal section, of the piston of the air pump.

The piston assembly P (FIG. 4) comprises a cylindrical piston rod 7 and a piston 8, which is molded integrally on the piston rod, and defines at least one air inlet hole 8'. The piston rod 7 projects somewhat above the outer surface of the piston 8, and an annular holding plate 10 is molded integrally on this free end of the piston rod 7, at a distance from the outer surface of the piston 8, this holding plate extending only over the central region of the piston 8. The edge region bounding the central opening in the annular disc D, which forms the pressure-generating element, is pushed into the annular gap 10' between the outer surface of the piston 8 and the underside of the holding plate 10. By this means, the annular disc D is held centrally, by the holding plate 10, on the outer surface of the piston 8, while the peripheral region of the annular disc D can move freely. The unobstructed width of the opening in the holding plate 10 is somewhat constricted compared to the unobstructed width of the opening in the cylindrical piston rod 7. The constriction of this opening 7' is formed by inwardly projecting shoulder 9 which serves as a stop for latches 6 on the post 3 in the piston housing G. Notches 9', for air to pass through an out of the pumping chamber, are machined into the inside edge which bounds the opening in the holding plate 10.

That end of the piston rod 7 which faces away from the piston 8 is provided with a securing element which enables the piston assembly P to be fixed to an item of equipment (not represented) which is to be supplied with air. A screw-fastening is provided in the present embodiment. For this purpose, that free end of the piston rod 7 which faces away from the piston 8 possesses a portion which is widened, the wall 11 bounding this widened portion being provided with an internal thread and being bounded, in the upward direction, by shoulder 12. Radially outwardly projecting ring 13 is molded integrally on the free edge of the piston rod 7, the diameter of this projecting ring essentially corresponding to that of the piston 8. This projecting ring 13 serves to reinforce the piston assembly P. Reinforcing struts 14 can be provided, as additional reinforcement, these struts being molded integrally on the piston rod 7 and extending radially between the piston 8 and the projecting ring 13.

On assembling the piston assembly P, the membrane-like annular disc D is first fitted into the annular gap 10' between the holding plate 10 and the outer surface of the piston 8. The piston assembly P, with the piston 8 which carries the annular disc D, is then pushed into the opening in the piston housing G, and the cylindrical post 3 of the piston housing G is, at the same time, inserted into the cylindrical piston rod 7. The external diameter of the cylindrical post 3 in the piston housing G is somewhat smaller than the internal diameter of the cylindrical piston rod 7, so that the post 3 can be moved, telescopingly in the piston rod 7. This completes the assembly of the air pump. The chamfers 6' on the detents 6 and the resiliency of the webs 5 facilitate the pushing-in operation. When the piston housing G is pulled out, the detents 6 strike the shoulder 9 at the sealed end of the piston rod 7, thus limiting the movement of the piston housing G and preventing it from being pulled off the piston assembly P, except by applying considerable pressure, and, if necessary, inclining it slightly.

The piston rod of the air pump is thus fixed and the piston housing is used to operate the pump. Only while the piston housing is being pressed in does the membrane-like annular disc come into sealing contact against the inner wall of the piston housing while, on pulling out the piston housing, the disc yields, moves away from the outer surface of the piston, and detaches itself from the inner wall of the piston housing.

I claim:

1. An air pump comprising (a) a piston housing having an axis and including
  (1) an inner wall extending about the axis,
  (2) a top closure and
  (3) an axially extending cylindrical post integrally molded on the top closure and having a free end remote therefrom, (b) a piston assembly positioned within the piston housing for relative movement with respect to the top closure, the piston assembly including
  (1) an axially extending cylindrical piston rod having two open ends, the piston housing post projecting into the cylindrical piston rod through one of the open ends facing the top closure and the piston rod being guided along the post with a slight clearance during the movement of the piston, the one open piston rod end defining an air outlet port, and a radially inwardly directed shoulder on the cylindrical piston rod constricting the air outlet port, the air outlet port being arranged between the shoulder and the cylindrical post,
  (2) a radially outwardly directed piston on the cylindrical piston rod at the one open piston rod end, the piston, the top piston housing closure and the piston housing inner wall defining a pumping chamber, the piston having an air inlet port leading to the pumping chamber and the air outlet port leading from the pumping chamber,
  (3) a radially outwardly directed annular holding plate at the one open piston rod end, the holding plate being slightly spaced from the piston in the direction of the top piston housing closure, the holding plate and the piston defining an annular gap therebetween, and
  (4) means at the open piston rod end remote from the one open end thereof for securing equipment to be supplied with air by the pump, and (c) a pressure-generating element consisting of a resilient, membrane-like annular disc centered on the piston in the annular gap and loosely held on one surface of piston facing the pumping chamber, the diameter of the disc being at least equal to the diameter of the piston whereby the disc bears against the inner piston housing wall and a sealing fit when the piston assembly is moved towards the top piston housing closure.

2. The air pump of claim 1, wherein a plurality of circumferentially spaced incisions in the free end of the cylindrical piston housing post define webs therebetween, and further comprising radially outwardly projecting detents on the webs, the detents cooperating with the shoulder on the cylindrical piston rod for stopping the movement of the piston rod along the post in one end position.

3. The air pump of claim 1, wherein the remote open piston rod end has a diameter larger than that of the remaining part of the cylindrical piston rod, an inwardly projecting shoulder separating the the larger diameter piston rod end from the remaining part, and the securing means being constituted by a screw thread along the inner wall of the larger diameter piston rod end.

4. The air pump of claim 1, further comprising a radially outwardly directed ring at the open end of the piston rod remote from the one end, the piston and the ring having the substantially the same outer diameter.

5. The air pump of claim 4, further comprising radially outwardly projecting reinforcing struts molded integrally on the piston rod and extending between the piston and the ring.

* * * * *

UNITED STATES PATENT AND TRADEMARK OFFICE

CERTIFICATE OF CORRECTION

PATENT NO. : 4,462,767

DATED : July 31, 1984

INVENTOR(S) : Dieter Dorsch

It is certified that error appears in the above-identified patent and that said Letters Patent is hereby corrected as shown below:

Title page, item (73), assignee's address should read -- Eppingen-Muhlbach, Germany --.

Signed and Sealed this

*Seventh* Day of *May 1985*

[SEAL]

*Attest:*

DONALD J. QUIGG

*Attesting Officer*

*Acting Commissioner of Patents and Trademarks*